US005902782A

United States Patent [19]

Hall et al.

[11] Patent Number: 5,902,782

[45] Date of Patent: May 11, 1999

[54] DETERGENT COMPOSITIONS COMPRISING STABILISED POLYAMINO ACID COMPOUNDS

[75] Inventors: Robin Gibson Hall, Newcastle-upon-Tyne, United Kingdom; Alan David Willey, Cincinnati, Ohio

[73] Assignee: Procter & Gamble Company, Cincinnati, Ohio

[21] Appl. No.: 08/875,238

[22] PCT Filed: Jan. 5, 1996

[86] PCT No.: PCT/US96/00522

§ 371 Date: Feb. 5, 1998

§ 102(e) Date: Feb. 5, 1998

[87] PCT Pub. No.: WO96/22352

PCT Pub. Date: Jul. 25, 1996

[30] Foreign Application Priority Data

Jan. 20, 1995 [GB] United Kingdom ..... 9501112

[51] Int. Cl.[6] ..... C11D 17/00; C11D 3/37; C11D 3/382; C11D 3/384

[52] U.S. Cl. ..... 510/349; 510/344; 510/441; 510/444; 510/463; 510/490

[58] Field of Search ..... 510/349, 344, 510/438, 440, 441, 442, 443, 444, 463, 475, 476, 490

[56] References Cited

U.S. PATENT DOCUMENTS

| | | | |
|---|---|---|---|
| 4,325,829 | 4/1982 | Duggleby et al. | 252/109 |
| 5,084,270 | 1/1992 | Ciaudelli | 424/59 |
| 5,183,601 | 2/1993 | Jisai et al. | 252/524 |
| 5,266,237 | 11/1993 | Freeman et al. | 252/542 |
| 5,284,512 | 2/1994 | Koskan et al. | 106/416 |
| 5,520,842 | 5/1996 | Ponce et al. | 252/174.24 |
| 5,643,863 | 7/1997 | Guerin et al. | 510/466 |

FOREIGN PATENT DOCUMENTS

| | | |
|---|---|---|
| 94/14939 | 7/1994 | WIPO . |

*Primary Examiner*—Ardith Hertzog
*Attorney, Agent, or Firm*—C. Brant Cook; Kim W. Zerby; Jacobus C. Rasser

[57] ABSTRACT

Detergent compositions comprising polyamino acid compounds and salts thereof are provided. More particularly, detergent compositions containing a polyamino acid compound/protein particle comprising at least one polyamino acid compound coated with at least one protein, detergent compositions containing a polyamino acid compound/protein particle comprising at least one protein coated with at least one polyamino acid compound, and detergent compositions containing a polyamino acid compound/protein agglomerate are provided. The polyamino acid compound/protein particle and/or agglomerate resists degradation of the polyamino acid compound.

14 Claims, No Drawings

DETERGENT COMPOSITIONS COMPRISING STABILISED POLYAMINO ACID COMPOUNDS

FIELD OF THE INVENTION

The present invention relates to the use of polyamino acid containing compounds and salts thereof in detergent compositions. More particularly, it relates to the use of a polyamino acid, including polyaspartic acid, wherein said polyamino acid is in close physical proximity with a protein so as to protect it from degradation.

BACKGROUND OF THE INVENTION

Polyamino acid agents can be used in detergent compositions as builders or dispersing agents. Such disclosure is given in EP 454126 which described polyamino acids, including polyaspartic acid, as biodegradable builders/co-builders in the formulation of detergents. The said polymers, especially those derived from aspartic acid, glutamic acid and mixtures thereof, are described as resistant to heat, stable to pH, non toxic, non irritant and entirely biodegradable. However, a problem encountered by such use is the degradability of those polymers under storage and over a period of time. PCT/US93/12090 discloses the use of polyamino acid protected from contact with a level of alkalinity as would cause degradation thereof. The said polyamino acid is provided with a coating, encapsulated or mixed in the form of an agglomerate or granulate with at least one other material which is preferably an alkaline or alkaline reacting compound. However, research by the present Applicant has revealed that this kind of protection will also degrade under storage. This being 'partially' due to the enzymatic action and alkaline hydrolysis.

It has now been found that a detergent composition containing a detersive surfactant, at least one polyamino acid compound and at least one protein wherein said polyamino acid compound and said protein are in close physical proximity shows enhanced storage stability.

A further advantage to the close physical proximity of said polyamino acid compound and said protein is the enhanced stability and protection against bleaches.

It is a further object of the present invention to provide a detergent composition with effective stain and soil removal performance.

SUMMARY OF THE INVENTION

The present invention relates to a detergent composition containing a detersive surfactant, at least one polyamino acid compound and at least one protein wherein said polyamino acid compound and said protein are in close physical proximity.

For the purpose of the present invention, the term close physical proximity means one of the following:

i) an agglomerate or extrudate in which said polyamino acid compound and said protein are in intimate admixture;

ii) a polyamino acid particulate coated with one or more layers wherein at least one layer contains the protein;

iii) a protein coated with one or more layers wherein at least one layer contains the polyamino acid compound.

It has to be understood by close physical proximity that the polyamino acid compound and the protein are not two separate discrete particles in the detergent composition.

The polyamino acid compound and the protein mixture may be present within the detergent composition in a form selected from an agglomerate, a granulate, a tablet and mixture thereof.

Also provided herein is a process for producing such mixture in a form of an agglomerate within a detergent composition.

TECHNICAL FIELD OF THE INVENTION

The present invention contemplates dispersant containing detergent compositions having an excellent storage stability against enzymes as well as against bleaches. More particularly, it relates to a detergent composition containing a detersive surfactant, at least one polyamino acid compound and at least one protein wherein said polyamino acid compound and said protein are in close physical proximity.

An essential component for the purpose of the invention is a polyamino acid compound.

The expression 'polyamino acid compound' includes herein not only a polyamino acid as such but also a derivative therof, such as an amide, an ester or a salt. The polyamino acid may be a homopolymer or may be a copolymer of two or more amino acids. The amino acid may be a D-amino acid, an L-amino acids or a mixture, e.g. a racemic mixture, therof. The amino acid include, for instance, alanine, glycine, tyrosine, serine and lysine, although glutamic, carboxyglutamic and aspartic acids are preferred. Of these, aspartic acid is particularly preferred.

Normally, for the purpose of formulating a detergent composition, in particular a laundry detergent composition, the polyamino acid will be used in the form of a salt therof, preferably an alkali metal salt and more preferably the sodium salt.

It will be understood that the polyamino acid compound may be constituted by a mixture of two or more compounds of the appropriate description.

The molecular weight of the polyamino acid compound may be varied within wide limits. Preferably, the molecular weight is from 500 to 200,000, more preferably 2000 to 20,000.

The polyamino acid described herein before will comprise from 10% to 90%, preferably from 10% to 40% and more preferably from 10% to 20% by weight of the polyamino acid-protein mixture.

The other essential component useful for the purpose of the invention is a protein which is in intimate contact with the polyamino acid so as to protect it from attack by enzymes and further by bleaches.

By protein, it is meant any of a class of high molecular-weight polymer compounds composed of a variety of $\alpha$-amino acids joined by peptide linkages, excluding those from a group of catalytic proteins that are produced by living cells and that mediate and promote the chemical processes of life without themselves being altered or destroyed.

Suitable proteins for the purpose of the invention are micro-organisms (yeast, bacteria, mold, etc.) and those proteins extracted therefrom, animal proteins (collagen, gelatin, glue, keratin, casein, egg albumin, etc.) and vegetable proteins (soybean protein, wheat gluten, etc.).

A preferred protein is white egg albumin.

The protein described herein before will comprise from 10% to 90%, preferably from 10% to 40% and more preferably from 10% to 20% by weight of the polyamino acid-protein mixture.

According to the present invention, a polyamino acid compound is stabilised against degradation sufficiently to render it acceptably storage-stable. This is effected, in particular, by protecting the said compound from contact with enzymes, bleaches and high alkalinity. Said stabilisation may be obtained by admixing to said polyaspartate a protein such as described herein before wherein said polyamino acid compound and said protein are in close physical proximity (e.g. the protein is admixed to the polyamino acid in a such intimate contact that the enzymes, source of damage for said polyamino acid, will preferentially and selectively attack the protein instead of the polyamino acid compound).

Another advantage to said mixture is the further protection of said polyamino acid against bleaches and high alkalinity which have also been shown as being detrimental to the stability of said polyamino acid upon storage.

The stabilisation or protection should be such that the amount of degradation of the polyamino acid compound in the detergent composition is less than 50% over a 4 week storage period under stressed conditions (90° F. (32.2° C.) and 80% relative humidity) and preferably less than 30%.

Further components may be admixed to said mixture. Suitable components are those having no deleterious effect on the mixture properties so that the amount of degradation of the polyamino acid remains as specified herein before.

Suitable components which may be admixed to said mixture are carbonates (including bicarbonates), sulphates and aluminosilicates.

Another preferred embodiment suitable for the purpose of the invention comprises agglomerates formed from the polyamino acid and the protein mixture and contained in such detergent composition to enhance stabilisation. Other components may, of course, be included in such agglomerates. The agglomeration of the polyamino acid compound and the protein may be carried out using any suitable agglomeration technique and apparatus, if appropriate with compatible agglomeration auxiliaries. Such techniques, apparatus and auxiliaries are well-known in the detergent formulating art. Once the agglomerates are formed, they may be dried, if required, by conventional means.

A suitable process for producing a detergent composition, containing said polyamino acid-protein mixture in the form of an agglomerate, comprises the steps of:

a—contacting said protein with said polyamino acid in the presence of water, b—agitating the resulting mixture so as to obtain a solid brittle agglomerate, c—grinding said agglomerate so as to obtain a size of from 250 $\mu$m to 800 $\mu$m, d—incorporating the agglomerate in the detergent composition.

A typical agglomerate formulation comprises:

| | |
|---|---|
| Polyamino acid compound | 10 to 90% |
| Protein | 10 to 40% |

The molten materials, viz the polyamino acid compound and the protein agglomerating agent are fed to the agglomerator at a temperature between 35° C. and 40° C. The resulting mass is then mixed for a further 3 hours until a yellow/browned color paste is formed. The mixing is then stopped and the paste is left in an oven at 35° C. for 24 hours. The resulting solid is crushed in a mortar and pestle to a fine powder. The product is then sieved and materials that are greater than 800 micrometers and smaller than 250 micrometers are removed.

The stabilised polyamino acid (e.g. the polyamino acid-protein mixture) according to the present invention is used as a dispersing agent (which term includes a clay-soil-suspending agent and/or an anti-redeposition agent) in solid (e.g. granular or other particulate) detergent compositions and will generally be employed therein at a level of from 0.1% to 50%, usually at least 0.4%, preferably 1 to 15%, more preferably 1% to 10% and most preferably 2.5% to 5.5% by weight of the detergent composition.

The polyamino acid-protein mixture will usually have a weight ratio of said polyamino acid to said protein of from 9:1 to 1:9, preferably from 4:1 to 1:4 and more preferably from 2:1 to 1:2.

Although the polyamino acid-protein mixture may be included in a wide variety of cleaning compositions, for example hard-surface and other household cleaners and dishwashing compositions, they are particularly suitable for use in laundry detergent compositions, e.g. general-purpose or heavy-duty laundry detergent compositions. These will contain not only the stabilised polyamino acid compound-protein mixture and detersive surfactant but also, optionally, one or more further components conventional in the art; these may be selected from, for example, a detergent builder, a bleach (in particular a source of hydrogen peroxide, e.g. sodium perborate or sodium percarbonate), a bleach activator, an enzyme, a polymeric soil-release agent, a chelating agent, a conventional dispersing agent, a brightener, a suds suppressor, a pH-buffering agent, a dye, a dye transfer inhibition agent or a pigment. It will be understood that any of the above-mentioned components, whether essential or optional, may be constituted, if desired, by a mixture of two or more compounds of the appropriate description.

Detersive Surfactants

The total amount of surfactants will be generally up to 70%, typically 1 to 55%, preferably 1 to 30%, more preferably 5 to 25% and especially 10 to 20% by weight of the total composition.

Nonlimiting examples of surfactants useful herein include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y(CHOSO_3^-M^+)$ $CH_2CH_3$ where x and (y+1) are integers of at least 7, preferably at least 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE"), including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Other suitable surfactants suitable for the purpose of the invention are the anionic alkali metal sarcosinates of formula:

$R\text{-}CON(R^1)CH_2COOM$ wherein R is a $C_9$–$C_{17}$ linear or branched alkyl or alkenyl group, $R^1$ is a $C_1$–$C_4$ alkyl group and M is an alkali metal ion. Preferred examples are the lauroyl, cocoyl ($C_{12}$–$C_{14}$), myristyl and oleyl methyl sarcosinates in the form of their sodium salts.

Mixtures of anionic and nonionic surfactants are especially useful. Other conventional useful surfactants are listed in standard texts.

Adjunct Ingredients

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Builders—Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form.

Granular formulations typically comprise from 10% to 80%, more typically from 15% to 50% by weight, of the detergent builder. Lower or higher levels of builder, however, are not meant to be excluded.

Inorganic or phosphate-containing detergent builders include, but are not limited to, the alkali metal, ammonium and alkanolammonium salts of polyphosphates (exemplified by the tripolyphosphates, pyrophosphates, and glassy polymeric meta-phosphates).

Non-phosphate builders may also be used. These can include, but are not restricted to phytic acid, silicates, alkali metal carbonates (including bicarbonates and sesquicarbonates), sulphates, aluminosilicates, monomeric polycarboxylates, homo or copolymeric polycarboxylic acids or their salts in which the polycarboxylic acid comprises at least two carboxylic radicals separated from each other by not more than two carbon atoms, organic phosphonates and aminoalkylene poly (alkylene phosphonates). The compositions herein also function well in the presence of the so-called "weak" builders (as compared with phosphates) such as citrate, or in the so-called "underbuilt" situation that may occur with zeolite or layered silicate builders.

Examples of silicate builders are the so called 'amorphous' alkali metal silicates, particularly those having a $SiO_2$:$Na_2O$ ratio in the range 1.6:1 to 3.2:1 and crystalline layered silicates, such as the layered sodium silicates described in U.S. Pat. No. 4,664,839. NaSKS-6 is the trademark for a crystalline layered silicate marketed by Hoechst (commonly abbreviated herein as "SKS-6"). Unlike zeolite builders, the NaSKS-6 silicate builder does not contain aluminum. NaSKS-6 has the delta-$Na_2Si_2O_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2Si_2O_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$Na_z[(AlO_2)_z(SiO_2)_y].xH_2O$$

wherein z and y are integers of at least 6, the molar ratio of z to y is in the range from 1.0 to 0.5, and x is an integer from 15 to 264.

Useful aluminosilicate ion exchange materials are commercially available. These aluminosilicates can be crystalline or amorphous in structure and can be naturallyoccurring aluminosilicates or synthetically derived. A method for producing aluminosilicate ion exchange materials is disclosed in U.S. Pat. No. 3,985,669. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from 20 to 30, especially 27. This material is known as Zeolite A. Dehydrated zeolites (x=0–10) may also be used herein. Preferably, the aluminosilicate has a particle size of 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287 and U.S. Pat. No. 3,635,830. See also "TMS/TDS" builders of U.S. Pat. No. 4,663,071. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether or acrylic acid, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in EP 0,200,263.

Other suitable polycarboxylates are disclosed in U.S. Pat. No. 4,144,226 and in U.S. Pat. No. 3,308,067. See also U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for handlaundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Bleaching Compounds—Bleaching Agents and Bleach Activators—The detergent compositions herein may optionally contain bleaching agents or bleaching compositions containing a bleaching agent and one or more bleach activators. When present, bleaching agents will typically be at levels of from 0.1% to 60%, more typically from 1% to 30% and more preferably from 5% to 20% by weight, of the detergent composition, especially for fabric laundering.

The bleaching agents used herein can be any of the bleaching agents useful for detergent compositions in textile cleaning, hard surface cleaning, or other cleaning purposes that are now known or become known. The bleaching agent, source of alkaline hydrogen peroxide in the wash liquor, is an inorganic perhydrate bleach normally in the form of the sodium or magnesium salt.

The perhydrate may be any of the alkali inorganic salts such as perborate monohydrate or tetrahydrate, percarbonate, perphosphate and persilicate salts, but is conventionally an alkali metal perborate or percarbonate. Sodium percarbonate, which is the preferred perhydrate, is an addition compound having a formula corresponding to $2Na_2CO_3.3H_2O_2$, and is available commercially as a crystalline solid. Most commercially available material includes a low level of a heavy metal sequestrant such as EDTA, 1-hydroxyethylene 1,1-diphosphonic acid (HEDP) or an aminophosphonate, that is incorporated during the manufacture process. For the purposes of the detergent composition aspect of the invention, the percarbonate can be incorporated into detergent compositions without additional protection, but preferred executions of such compositions utilise a coated form of the material. A variety of coatings can be used including borosilicate borate, boric acid and citrate or sodium silicate of $SiO_2$:$Na_2O$ ratio from 1.6:1 to 3.4:1, preferably 2.8:1, applied as an aqueous solution to give a level of from 2% to 10%, (normally from 3% to 5%) of silicate solids by weight of the percarbonate. However the most preferred coating is a mixture of sodium carbonate and sulphate or sodium chloride.

The particle size range of the crystalline percarbonate is from 350 micrometers to 1 500 micrometers with a mean of approximately 500–1000 micrometers.

Another category of bleaching agent that can be used in place of or in combination with the mixture of an inorganic perhydrate and a bleach activator encompasses the preformed peracid bleaching agents and salts thereof. Suitable examples of this class of agents include (6-octylamino)-6-oxo-caproic acid, (6-nonylamino)-6-oxo-caproic acid, (6-decylamino)-6-oxo-caproic acid, magnesium monoperoxyphthalate hexahydrate, the magnesium salt of metachloro-perbenzoic acid, 4-nonylamino-4-oxoperoxybutyric acid and diperoxydodecanedioic acid. Such bleaching agents are disclosed in U.S. Pat. No. 4,483,781, U.S. Pat. No. 4,634551, EP 0,133,354, U.S. Pat. No. 4,412,934 and EP 0,170,386.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. The amount of bleach activators will typically be from 0.1% to 60%, more typically from 0.5% to 40% by weight of the detergent composition.

Various nonlimiting examples of activators are disclosed in U.S. Pat. No. 4,915,854 and U.S. Pat. No. 4,412,934. The nonanoyloxybenzene sulfonate (NOBS), isononanoyloxybenzene sulfonate (ISONOBS) and tetraacetyl ethylene diamine (TAED) activators are typical, and mixtures thereof can also be used.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from 6 to 12 carbon atoms, $R^2$ is an alkylene containing from 1 to 6 carbon atoms, $R^5$ is H or alkyl, aryl, or alkaryl containing from 1 to 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamidocaproyl) oxybenzenesulfonate, and mixtures thereof as described in U.S. Pat. No. 4,634,551.

Another class of bleach activators comprises the benzoxazin-type activators disclosed in U.S. Pat. No. 4,966,723. A highly preferred activator of the benzoxazin-type is:

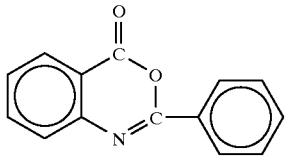

Still another class of preferred bleach activators includes the acyl lactam activators, especially acyl caprolactams and acyl valerolactams of the formulae:

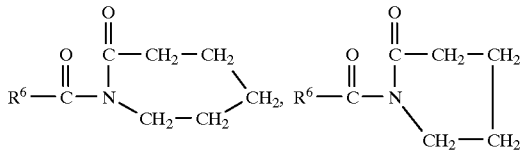

wherein $R^6$ is H or an alkyl, aryl, alkoxyaryl, or alkaryl group containing from 1 to 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784 which discloses acyl caprolactams, including benzoyl caprolactam, adsorbed into sodium perborate.

Another class of preferred bleach activators include the cationic bleach activators, derived from the valerolactam and acyl caprolactam compounds, of formula:

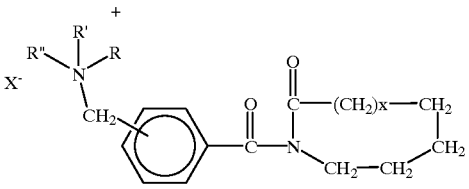

wherein x is 0 or 1, substituents R, R' and R" are each C10 alkyl or C2–C4 hydroxy alkyl groups, or $[(C_yH_{2y})O]_n$—R'" wherein y=2–4, n=1–20 and R'" is a C1–C4 alkyl group or hydrogen and X is an anion.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718. If used, detergent compositions will typically contain from 0.025% to 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and EP 549,271A1, 549,272A1, 544,440A2, and 544,490A1; Preferred examples of these catalysts include $Mn^{IV}_2(u\text{-}O)_3$(1,4,7-trimethyl-1,4,7-triazacyclononane)$_2(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4(ClO_4)_4$, $Mn^{III}Mn^{IV}_4(u\text{-}O)_1(u\text{-}OAc)_2$-(1,4,7-trimethyl-1,4,7-triazacyclononane)$_2(ClO_4)_3$, $Mn^{IV}$-(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; 5,227,084;

As a practical matter, and not by way of limitation, the compositions and processes herein can be adjusted to provide on the order of at least one part per ten million of the active bleach catalyst species in the aqueous washing liquor, and will preferably provide from 0.1 ppm to 700 ppm, more preferably from 1 ppm to 500 ppm, of the catalyst species in the laundry liquor.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Preferred biodegradable non-phosphorus chelants for use herein are ethylenediamine disuccinate ("EDDS"), especially the [S,S] isomer as described in U.S. Pat. No. 4,704,233, ethylenediamine-N,N'-diglutamate (EDDG) and 2-hydroxypropylene-diamine-N,N'-disuccinate (HPDDS) compounds.

Amino phosphonates are also suitable for use as chelating agents in the compositions of the invention when at least low levels of total phosphorus are permitted in detergent compositions, and include ethylenediaminetetrakis (methylenephosphonates) available under the trademark DEQUEST from Monsanto. Preferably, these amino phosphonates do not contain alkyl or alkenyl groups with more than 6 carbon atoms.

Polyfunctionally-substituted aromatic chelating agents are also useful in the compositions herein. See U.S. Pat. No. 3,812,044. Preferred compounds of this type in acid form are dihydroxydisulfobenzenes such as 1,2-dihydroxy-3,5-disulfobenzene.

If utilized, these chelating agents will generally comprise from 0.1% to 10% by weight of the detergent compositions herein. More preferably, if utilized, the chelating agents will comprise from 0.1% to 3.0% by weight of such compositions.

Enzymes—Enzymes can be included in the formulations herein for a wide variety of fabric laundering purposes, including removal of protein-based, carbohydrate-based, or triglyceride-based stains, for example, for the prevention of fugitive dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability and stability versus active detergents and builders. In this respect bacterial or fungal enzymes are preferred, such as bacterial amylases and proteases, and fungal cellulases.

Enzymes are normally incorporated at levels sufficient to provide up to 5 mg by weight, more typically 0.01 mg to 3 mg, of active enzyme per gram of the composition. Stated otherwise, the compositions herein will typically comprise from 0.001% to 5%, preferably 0.01%–1% by weight of a commercial enzyme preparation.

Suitable examples of proteases are the subtilisins which are obtained from particular strains of B. subtilis and B. licheniforms. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in GB 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see EP 130,756) and Protease B (see EP 257, 189).

Amylases include, for example, α-amylases described in GB1,296,839 (Novo), RAPIDASE, International Bio-Synthetics, Inc. and TERMAMYL, Novo Industries. FUNGAMYL (Novo) is especially useful.

The cellulase usable in the present invention include both bacterial or fungal cellulase. Preferably, they will have a pH optimum of between 5 and 9.5. Suitable cellulases are disclosed in U.S. Pat. No. 4,435,307, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832. ENDO A, CAREZYME both from Novo Industries A/S are especially useful.

Suitable lipase enzymes for detergent usage include those produced by microorganisms of the Pseudomonas group, such as Pseudomonas stutzeri ATCC 19.1 54, as disclosed in GB 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano–CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE enzyme derived from Humicola lanuginosa and commercially available from Novo (see also EP 0,341, 947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 assigned to Novo Industries A/S.

A wide range of enzyme materials and means for their incorporation into synthetic detergent compositions are also disclosed in U.S. Pat. No. 3,553,139. Enzymes are further disclosed in U.S. Pat. No. 4,101,457 and in U.S. Pat. No. 4,507,219. Enzyme materials useful for liquid detergent formulations, and their incorporation into such formulations, are disclosed in U.S. Pat. No. 4,261,868. Enzymes for use in detergents can be stabilized by various techniques. Enzyme stabilization techniques are disclosed and exemplified in U.S. Pat. No. 3,600,319 and EP 0 199 405. Enzyme stabilization systems are also described, for example, in U.S. Pat. No. 3,519,570.

Enzyme Stabilizers—The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from 0.05 to 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from 0.05% to 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from 0.25% to 10%, preferably from 0.5% to 5%, more preferably from 0.75% to 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Other Ingredients

A wide variety of other functional ingredients commonly used in detergent compositions can be included in the compositions of the present invention. These include additional clay soil removal/anti-redeposition agents, polymeric soil release agents, dye transfer inhibiting agents, brighteners, suds suppressors and fabric softeners. Suitable additional clay soil removal/anti-redeposition agents may include acrylic/maleic based copolymers, polyethylene glycol (PEG), water-soluble ethoxylated amines and carboxy methyl cellulose (CMC).

Other ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned photoactivators, dyes, fluorescers, fabric conditioners and hydrolyzable surfactants can be "protected" for use in detergents, including liquid laundry detergent compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to 6 carbon atoms and from 2 to 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between 6.5 and 11, preferably between 7.5 and 10.5. Liquid dishwashing product formulations preferably have a pH between 6.8 and 9.0. Laundry products are typically at pH 9–11. Techniques for controlling pH at recommended usage levels include the use of buffers, alkalis, acids, etc., and are well known to those skilled in the art.

The bulk density of granular detergent compositions is typically at least 450 g/liter, more usually at least 600 g/liter and more preferably from 650 g/liter to 1000 g/liter.

The invention is illustrated in the following non limiting examples, in which all percentages are on a weight basis unless otherwise stated.

In the detergent compositions, the abbreviated component identifications have the following meanings:

| | |
|---|---|
| LAS | Sodium linear $C_{12}$ alkyl benzene sulphonate |
| TAS | Sodium tallow alkyl sulphate |
| XYAS | Sodium $C_{1X}$–$C_{1Y}$ alkyl sulphate |
| C24EY | A $C_{12-14}$ predominantly linear primary alcohol condensed with an average of Y moles of ethylene oxide |
| C25EY | A $C_{12-15}$ predominantly linear primary alcohol condensed with an average of Y moles of ethylene oxide |
| C45EY | A $C_{14}$–$C_{15}$ predominantly linear primary alcohol condensed with an average of Y moles of ethylene oxide |
| CXYEZS | $C_{1X}$–$C_{1Y}$ sodium alkyl sulphate condensed with an average of Z moles of ethylene oxide per mole |
| polyhydroxy fatty acid amide | N-Lauroyl N-Methyl Glucamine |
| NaSKS-6 | Crystalline layered silicate of formula $\delta$-$Na_2Si_2O_5$ |
| PAS | Polyaspartic acid of molecular weight in the range of 500 to 200,000 |
| Carbonate | Anhydrous sodium carbonate |
| Silicate | Amorphous sodium silicate ($SiO_2$:$Na_2O$ ratio normally follows) |
| MA/AA | Copolymer of 1:4 maleic/acrylic acid, average molecular weight about 70,000 |
| Zeolite A | Hydrated Sodium Aluminosilicate of formula $Na_{12}[(AlO_2)(SiO_2)]_{12}.27H_2O$ having a primary particle size in the range from 1 to 10 micrometers |
| Photobleach | Tetra sulphonated zinc phthalocyanine |
| Citrate | Tri-sodium citrate dihydrate |
| Citric acid | Anhydrous Citric Acid |
| PB1 | Sodium perborate monohydrate bleach of nominal formula $NaBO_2.H_2O_2$ |
| PB4 | Sodium perborate tetrahydrate bleach of nominal formula $NaBO_2.H_2O_2.3H_2O$ |
| Percarbonate | Anhydrous sodium percarbonate bleach of empirical formula $2Na_2CO_3.3H_2O_2$ coated with a mixed salt of formula $Na_2SO_4.n.Na_2CO_3$ where n is 0.29 and where the weight ratio of percarbonate to mixed salt is 39:1 |
| TAED | Tetraacetyl ethylene diamine |
| Savinase | Proteolytic enzyme activity 4 KNPU/g |
| Alcalase | Proteolytic enzyme activity 3.3 AU/g |
| Lipolase | Lipolytic enzyme activity 100 KLU/g |
| Cellulase | Cellulytic enzyme activity 1000 SCEVU/g |
| Endo A | Cellulytic enzyme activity 5000 SCEVU/g all sold by NOVO Industries A/S |
| PVNO | Polyvinyl pyridine N-oxide polymer of molecular weight 10,000 |
| PVPVI | Polyvinyl pyrrolidone-co-imidazole) polymer of molecular weight in the range of 100 to 1000000 |
| MgSO4 | Anhydrous Magnesium Sulphate |
| SRP | modified anionic polyester Soil Release Polymer |
| CMC | Sodium carboxymethyl cellulose |
| EDDS | Ethylenediamine-N,N'-disuccinic acid, [S,S] isomer in the form of the sodium salt. |
| Brightener | Disodium 4,4'-bis-(2-sulphostyryl)-biphenyl. |
| DETPMP | Diethylenetriamine penta (Methylene phosphonic acid) marketed by Monsanto under the Trade name Dequest 2060. |
| Mixed Suds suppressor | 25% paraffin wax Mpt 50° C., 17% hydrophobic silica, 58% paraffin oil. |

EXAMPLE 1

Preparation of the Polyamino Acid-Protein Agglomerate Contained in a Detergent Composition.

100 g of a polyaspartic acid solution (25% active) was mixed with 20 g of albumin (100% active) in a round bottom flask. The resulting mixture was then stirred for a further 3 hours at a temperature between 35° C. and 40° C. at a paddle speed of 1 50 r.p.m, until a yellow/browned coloured paste formed. The mixing was then stopped and the paste was left in an oven at 35° C. for a further 24 hours. The resulting solid was crushed using a mortar and pestle into a fine powder (yellow/brown in color). The product was then sieved and materials that were greater than 800 microns and smaller than 250 microns were removed. The remaining material was used in the testing.

4.8% by weight of said polyaspartic acid/albumin agglomerate was taken and incorporated in a nil dispersant detergent matrix (100 g). The nil dispersant detergent matrix had the following composition in % by weight:

| | |
|---|---|
| 45AS | 6.84 |
| C25E3S | 1.71 |
| C24E5 | 3.37 |
| polyhydroxy fatty acid amide | 1.45 |
| Zeolite A | 10.19 |
| Citric | 2.45 |
| SKS-6 | 9.0 |
| Carbonate | 5.38 |
| CMC | 0.30 |
| SRP | 0.20 |
| PVNO | 0.02 |
| Savinase | 0.69 |
| Lipolase | 0.18 |
| Cellulase | 0.20 |
| Endo A | 0.25 |
| Termamyl | 0.6 |
| TAED | 3.75 |
| DETPMP | 0.6 |
| MgSO4 | 0.6 |
| Percarbonate | 16.9 |
| Brightener | 0.22 |
| Photoactivated bleach | 0.002 |
| Suds suppressor | 2.75 |
| Perfume | 0.35 |
| Water minors and miscellaneous to balance | |

Storage stability results of the polyaspartic acid-albumin agglomerate contained in a detergent composition vs a pure polyaspartate granule contained in a detergent composition after a 4 week storage period under stressed conditions (90° F. (32.2° C.) and 80% relative humidity).

A comparative composition was prepared containing 4% by weight of the polyaspartic acid granule and incorporated in 100 g of the herein before described nil dispersant detergent matrix.

The storage stability analysis was carried out on the stored product, after a 4 week storage period under stressed conditions (90° F. (32.2° C.) and 80% relative humidity), using HPLC. The results are as follows:

| polyaspartic acid/albumin agglomerate | polyaspartic acid granule |
|---|---|
| 80% | 50% |

It can be seen that the polyaspartic acid/albumin agglomerate contained in the detergent composition shows enhanced storage stability over the polyaspartic acid granule contained in the same detergent composition.

EXAMPLE 2

The following detergent compositions were prepared (parts by weight). Compositions A, B, C, D, E are in accordance with the present invention, wherein the polyaspartic acid/albumin agglomerate is as defined in Example 1 and composition F is a comparative composition wherein the polyaspartic acid/albumin agglomerate is replaced with a maleic acid/acrylic acid copolymer supplied by BASF.

| | A | B | C | D | E | F |
|---|---|---|---|---|---|---|
| LAS | — | — | 6.54 | 6.92 | 6.92 | — |
| TAS | — | — | 2.94 | 2.05 | 2.05 | — |
| 45AS | 6.84 | 6.86 | — | — | — | 6.84 |
| C25E3S | 1.71 | 1.71 | 0.16 | 0.16 | 0.16 | 1.71 |
| C45E7 | — | — | 4.0 | 4.0 | 5.0 | — |
| C24E5 | 3.37 | — | — | — | — | 3.37 |
| C25E5 | — | 2.21 | — | — | — | — |
| C25E3 | — | 1.16 | — | — | 3.0 | — |
| polyhydroxy fatty acid amide | 1.45 | 1.45 | — | — | — | 1.45 |
| Zeolite A | 10.19 | 10.2 | 18.0 | 20.2 | 26.0 | 10.19 |
| Citrate | — | — | — | 5.5 | 10.4 | — |
| Citric | 2.45 | 2.3 | 2.35 | — | — | 2.45 |
| SKS-6 | 9.0 | 8.5 | 8.64 | — | — | 9.0 |
| PAS-albumin agglomerate | 4.8 | 4.8 | 4.8 | 4.8 | 4.8 | — |
| Carbonate | 5.38 | 9.8 | 16.0 | 15.4 | 11.9 | 5.38 |
| Silicate (2.0 ratio) | — | — | 0.56 | 3.0 | 2.0 | — |
| Bicarbonate | — | — | 4.6 | — | 6.0 | — |
| Sulphate | — | 8.0 | — | — | 4.8 | — |
| MA/AA | — | 3.0 | — | — | 4.6 | 4.0 |
| CMC | 0.30 | 0.30 | 0.30 | 0.30 | 0.30 | 0.30 |
| SRP | 0.20 | 0.15 | 0.20 | 0.30 | 0.30 | 0.20 |
| PVPVI | — | — | — | 0.01 | 0.04 | — |
| PVNO | 0.02 | — | — | 0.01 | 0.04 | 0.02 |
| Savinase | 0.69 | 0.25 | 0.37 | 1.4 | — | 0.69 |
| Alcalase | — | — | — | — | 0.55 | — |
| Lipolase | 0.18 | 0.07 | 0.22 | 0.36 | 0.25 | 0.18 |
| Cellulase | 0.20 | — | — | — | 0.13 | 0.20 |
| Endo A | 0.25 | 0.12 | 0.13 | 0.13 | — | 0.25 |
| Termamyl | 0.6 | — | — | — | — | 0.6 |
| PB4 | — | — | — | 11.64 | — | — |
| PB1 | — | — | — | 8.7 | — | — |
| TAED | 3.75 | 1.6 | — | 5.0 | — | 3.75 |
| DETPMP | 0.6 | — | 4.8 | 0.38 | 0.6 | 0.6 |
| MgSO4 | 0.6 | 0.38 | 0.4 | 0.40 | — | 0.6 |
| Percarbonate | 16.9 | 10.0 | 17.5 | — | — | 16.9 |
| EDDS | — | 0.21 | 0.21 | — | — | — |
| Brightener | 0.22 | 0.18 | 0.19 | 0.19 | — | 0.22 |
| Photoactivated bleach | 0.002 | 0.002 | 0.002 | 0.002 | — | 0.002 |
| Suds suppressor | 2.75 | 2.75 | 0.85 | 0.85 | 1.0 | 2.75 |
| Perfume | 0.35 | 0.4 | 0.35 | 0.43 | 0.35 | 0.35 |
| Water minors and miscellaneous to balance | | | | | | |

Compositions A to E were all seen to have a good polyaspartic acid storage stability.

Test Protocol—Stain Removal

Four white cotton sheets were prewashed in a nil polymer detergent matrix of density ca 700 mg/liter. 10 stains were then applied to one sheet, 10 stains to the second sheet, 10 stains to the third one and 10 to the fourth one. Sets of eight test swatches of size 10 cm×10 cm squared were cut from each sheet.

The sets of fabric swatches were subjected to one wash cycle in an automatic washing machine(Miele type short wash cycle). The swatches were then assessed for removal of the particulate, greasy, enzymatic and bleachable stains using a well-established lightness measurement method.

In more detail, a Miele 756 WM automatic washing machine was employed, and the 90° C. short cycle programme selected. Water of 25° German hardness (=3.75 mol $Ca^{2+}$/liter) was used. 100 g of detergent, dispensed from a granulette dispensing device was employed. One swatch of each fabric type was washed along with a ballast load of 2.6 Kg of lightly soiled sheets.

Stain removal was assessed by making LAB (lightness) measurements using the X-rite (tradename) color eye spectrophotometer. An unstained cotton sheet was used as the reference. A stain removal index, ΔR, was calculated as follows:

$$\Delta R=[(L_{washed}-L_{unwashed})/(L_{unwashed}-L_{reference})]\times 100$$

where differences of ΔR below 4% are not significant.

Comparative Testing—Stain Removal

The above test protocol was followed in comparing the efficiency of Compositions A and F in removing different type of dispersant sensitive stains.

The results obtained were as follows:

| Average ΔR (%) | A | F |
|---|---|---|
| Average particulate | 57 | 61 |
| Average greasy | 63 | 57 |
| Average enzymatic | 43 | 45 |
| Average bleachable | 55 | 50 |

All results are non significant differences

The stain removal obtained for each of Compositions A and F is shown to be comparable. Thus the presence of albumin as co-agglomerating agent of the polyaspartic acid, in Composition A does not significantly compromise the stain removal capacity of that Composition versus that of Composition F.

What is claimed is:

1. A process for producing a detergent composition containing a detersive surfactant, at least one polyamino acid compound selected from the group consisting of homopolymers, copolymers of two or more aminoacids, and mixtures thereof and at least one protein selected from the group consisting of micro-organisms and proteins extracted therefrom, animal proteins and vegetable proteins; and which comprises the steps of:

a—contacting said protein with said polyamino acid compound in the presence of water, b—agitating the resulting mixture so as to obtain a solid brittle agglomerate, c—grinding said agglomerate so as to obtain a particle size of from about 250 μm to about 800 μm, d—incorporating the agglomerate in the detergent composition.

2. A process according to claim 1, wherein the weight ratio of said polyamino acid compound to said protein is from about 9:1 to about 1:9.

3. A process according to claim 2, wherein the weight ratio of said polyamino acid compound to said protein is from about 4:1 to about 1:4.

4. A process according to claim 2, wherein said polyamino acid compound is selected from the group consisting of polyaspartic acid and polyglutamic acid.

5. A detergent composition containing a detersive surfactant, a polyamino acid compound/protein agglomerate comprising at least one polyamino acid compound and at least one protein, and one or more detergent components selected from the group consisting of bleaching agents, dye transfer inhibiting agents, fabric softening agents, suds suppressors, enzymes, chelants, builders, soil release polymers, brighteners and mixtures thereof.

6. A detergent composition according to claim 5 wherein said polyamino acid compound is selected from a homopolymer or a copolymer of two or more amino acids.

7. A detergent composition according to claim 5 wherein said protein is selected from the group consisting of micro-organisms and those proteins extracted therefrom, animal proteins, vegetable proteins and mixtures thereof.

8. A detergent composition according to claim 5 wherein the weight ratio of said polyamino acid compound to said protein is about 9:1 to about 1:9.

9. A detergent composition according to claim 5 wherein said polyamino acid compound is selected from the group consisting of polyaspartic acid and polyglutamic acid.

10. A detergent composition containing a detersive surfactant, a polyamino acid compound/protein particle comprising at least one protein coated with at least one polyamino acid compound, and one or more detergent components selected from the group consisting of bleaching agents, dye transfer inhibiting agents, fabric softening agents, suds suppressors, enzymes, chelants, builders, soil release polymers, brighteners and mixtures thereof.

11. A detergent composition according to claim 10 wherein said polyamino acid compound is selected from a homopolymer or a copolymer of two or more amino acids.

12. A detergent composition according to claim 10 wherein said protein is selected from the group consisting of micro-organisms and those proteins extracted therefrom, animal proteins, vegetable proteins and mixtures thereof.

13. A detergent composition according to claim 10 wherein the weight ratio of said polyamino acid compound to said protein is about 9:1 to about 1:9.

14. A detergent composition according to claim 10 wherein said polyamino acid compound is selected from the group consisting of polyaspartic acid and polyglutamic acid.

* * * * *